US009074575B2

(12) United States Patent
Sakurai et al.

(10) Patent No.: US 9,074,575 B2
(45) Date of Patent: Jul. 7, 2015

(54) ENERGIZATION CONTROL APPARATUS FOR GLOW PLUG

(75) Inventors: Takayuki Sakurai, Komaki (JP); Takayuki Ohtani, Iwakura (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 1029 days.

(21) Appl. No.: 13/157,760

(22) Filed: Jun. 10, 2011

(65) Prior Publication Data

US 2011/0303649 A1 Dec. 15, 2011

(30) Foreign Application Priority Data

Jun. 11, 2010 (JP) ..... 2010-133770

(51) Int. Cl.

| | |
|---|---|
| ***F23Q 7/00*** | (2006.01) |
| ***F23Q 13/00*** | (2006.01) |
| ***F02P 19/02*** | (2006.01) |
| ***F02D 41/24*** | (2006.01) |

(52) U.S. Cl.

CPC ..... *F02P 19/025* (2013.01); *F02D 41/2432* (2013.01); *F02D 41/2464* (2013.01); *F02P 19/027* (2013.01)

(58) Field of Classification Search

CPC ..... F02D 41/2432; F02D 41/2464; F02P 19/025; F02P 19/027

USPC ..... 219/260, 262, 263, 264, 268

See application file for complete search history.

(56) References Cited

U.S. PATENT DOCUMENTS

| | | | | |
|---|---|---|---|---|
| 7,234,430 | B2 * | 6/2007 | Toedter et al. | 123/179.6 |
| 2009/0200286 | A1 * | 8/2009 | Reissner | 219/264 |
| 2010/0161150 | A1 | 6/2010 | Sakurai et al. | |

FOREIGN PATENT DOCUMENTS

JP 2010-127487 A 6/2010

* cited by examiner

*Primary Examiner* — Dana Ross
*Assistant Examiner* — Lindsey C Teaters
(74) *Attorney, Agent, or Firm* — Sughrue Mion, PLLC

(57) ABSTRACT

A GCU (21) includes calibration means (33) which supplies electric current to a glow plug (1) when an internal combustion engine EN to which the glow plug (1) is attached is stopped, to thereby obtain a pre-correction target resistance of the glow plug (1). The calibration means (33) supplies a predetermined first electric power to the glow plug (1) in a predetermined first energization period, and supplies a predetermined second electric power to the glow plug (1) after the first energization period. The second electric power is set such that, when the second electric power is supplied to the glow plug (1) and the temperature of the glow plug (1) becomes saturated, the temperature of the glow plug (1) becomes equal to the target temperature. Further, the first electric power is greater than the second electric power.

6 Claims, 8 Drawing Sheets

RTRE: RAPID TEMPERATURE RAISING ENERGIZATION
TME: TEMPERATURE MAINTAINING ENERGIZATION
CE: CORRECTION ENERGIZATION

ENERGIZATION CONTROL APPARATUS FOR GLOW PLUG

BACKGROUND OF THE INVENTION

1. Field of the Invention

The present invention relates to an energization control apparatus for a glow plug used, for example, for pre-heating of a diesel engine.

2. Description of the Related Art

Conventionally, in an automobile, a glow plug having a heating resistor which generates heat upon supply of electric current is used so as to assist startup of an engine, or to stably operate the engine. A heating resistor whose resistance increases with its own temperature; i.e., a heating resistor having a positive correlation with its temperature, has been widely used for glow plugs. Furthermore, a constant power control scheme and a resistance control scheme have been known as schemes for controlling the supply of electric current to a glow plug including such a heating resistor.

In the constant power control scheme, electric power supplied to a glow plug is obtained from a voltage applied to the glow plug and a current flowing therethrough, and electric current is supplied to the glow plug such that electric energy obtained through integration of the electric power becomes equal to a predetermined amount of electric energy. According to this control method, the glow plug generates heat in accordance with the supplied electric energy. Therefore, the temperature of the glow plug can be increased to a predetermined temperature through supply of a predetermined amount of electric energy.

However, maintaining the glow plug at a constant temperature is difficult in the case where the glow plug is thermally influenced from the outside, such as the case where the heating resistor of the glow plug is cooled because of a disturbance caused by a change in engine speed, load (throttle opening), water temperature, etc. Maintaining a constant temperature of the glow plug requires obtaining information regarding the engine speed, load, etc., from, for example, an ECU, and controlling the effective voltage applied to the glow plug on the basis of the obtained information. However, in such a case, a problem of increased processing load may arise.

Meanwhile, in the resistance control scheme, the supply of electric current to a glow plug is controlled such that the resistance of the glow plug approaches a target resistance corresponding to a target temperature. According to the resistance control scheme, even in the case where the glow plug is influenced by a temperature change caused by a disturbance, the only requirement is to change an effective voltage to be applied in accordance with a change in resistance of the glow plug caused by the disturbance. Accordingly, unlike the above-described scheme, processing load does not increase, and the glow plug can be maintained at a constant temperature with relatively ease.

Incidentally, in order to control the supply of electric current to a glow plug in accordance with the resistance control scheme, a target resistance of the glow plug must be set. When the target resistance is set, deviation in resistance among individual glow plugs caused by various factors may be taken into consideration. Specifically, a resistance (pre-correction target resistance) which serves as a reference during control is set for each individual glow plug, and a target resistance is set on the basis of the pre-correction target resistance. Through performing control on the basis of the pre-correction target resistance set for each glow plug, energization control can be performed such that deviation among a plurality of glow plugs approaches zero.

Notably, the pre-correction target resistance is set as follows. In a state in which disturbances arising during operation of an internal combustion engine (e.g., cooling of the heating resistance by swirl or fuel injection) do not exist, the temperature of the glow plug is increased to a temperature which serves as a control target (target temperature), and the resistance of the glow plug at that time is obtained and set as a pre-correction target resistance. The target resistance can be obtained by correcting the obtained pre-correction target resistance in accordance with a change in water temperature or outside air temperature, a change in the target temperature, etc.

Also, the following method has been proposed so as to obtain the pre-correction target resistance (see, for example, Patent Document 1). That is, as described above, the resistance among individual glow plugs varies because of various factors. Therefore, even among glow plugs of the same model number, the relation between temperature and resistance may vary. However, the relation between a cumulative amount of supplied electric power and an amount of generated heat is determined by the material of the heating resistor of each glow plug, and its deviation is relatively small. In consideration of this point, electric current is first supplied to a glow plug serving as a reference such that its temperature rise becomes saturated at a target temperature, and a cumulative amount of electric power (cumulative electric energy) supplied to the glow plug at that time is obtained. The obtained cumulative electric energy is supplied to a glow plug when an internal combustion engine is not operated (stopped). Further, the resistance of the glow plug at that time (that is, when the resistance of the glow plug becomes saturated and the temperature of the glow plug becomes equal to the target temperature) is measured, whereby the pre-correction target resistance of the glow plug can be obtained. Notably, in the above-described technique, when electric power is supplied to a glow plug, a constant electric power is supplied to the glow plug.

[Patent Document 1] Japanese Patent Application Laid-Open (kokai) No. 2010-127487

3. Problems to be Solved by the Invention

In the above-described method, an operation of setting a pre-correction target resistance for an individual glow plug (hereinafter this operation will be referred to as "calibration") is performed when an internal combustion engine is not operated, and, at the time of calibration, the glow plug is heated to a target temperature. That is, at the time of calibration, the glow plug may be heated to a high temperature in a state in which a driver and other persons are away from an automobile. Also, at the time of calibration, since the glow plug is heated to the target temperature, a large amount of electric power is consumed from a battery. From the viewpoints of safety and electric power consumption, the time required for calibration is preferably shortened as much as possible. However, in the case where constant electric power is supplied to a glow plug as in the above-described technique, a relatively long time may be needed to saturate the resistance of the glow plug, for the following reason.

That is, at the time of calibration, the resistance of the glow plug is obtained after the respective temperatures of not only the heating resistor but also a control coil, a center rod, and a power supply harness connected to the glow plug become saturated, and the resistance is set as a pre-correction target resistance. Accordingly, in the case where constant electric power is supplied to the glow plug, at an initial stage of electric power supply (a stage in which the temperatures of the control coil, the center rod, etc., have not yet become saturated), the ratio of the resistance of the heating resistor to the resistance of the glow plug (the sum of the resistance of the heating resistor and the resistances of the control coil, the center rod, the harness, etc.) is relatively large. Therefore, the heating resistor rapidly rises in temperature, and reaches a target temperature at a relatively early stage. However, the respective temperatures of the control coil, the center rod, etc., increase gradually because the temperature of the heating resistor is gradually transmitted to the control coil, the center rod, etc. Therefore, a long time is needed to saturate the resistance of the glow plug, and, as a result, a relatively long time is needed for calibration.

SUMMARY OF THE INVENTION

The present invention has been achieved in view of the above circumstances, and an object thereof is to provide an energization control apparatus for a glow plug which controls the supply of electric current to the glow plug in accordance with a resistance control scheme so that the resistance of the glow plug coincides with a target resistance based on a pre-correction target resistance, and which apparatus can greatly shorten the time required for calibration.

The above object of the invention has been achieved by providing an energization apparatus configured as follows. As needed, the actions and effects specific to individual configurations will be additionally described.

Configuration 1. An energization control apparatus for a glow plug which generates heat upon supply of electric current thereto and having a resistance which changes in positive correlation with a change in its own temperature, the energization control apparatus being adapted to control the supply of electric current to the glow plug in accordance with a resistance control scheme in which, when an internal combustion engine to which the glow plug is attached is stopped, electric current is supplied to the glow plug such that its temperature reaches a predetermined target temperature, a resistance of the glow plug at the time that the glow plug reaches the predetermined target temperature is obtained as a pre-correction target resistance, and the supply of electric current to the glow plug is controlled such that the resistance of the glow plug becomes equal to a target resistance based on the pre-correction target resistance, the energization control apparatus comprising:

calibration means for supplying electric current to the glow plug when the internal combustion engine to which the glow plug is attached is stopped, to thereby obtain the pre-correction target resistance of the glow plug, wherein the calibration means supplies a predetermined first electric power to the glow plug in a predetermined first energization period, and supplies a predetermined second electric power to the glow plug after the first energization period;

the second electric power is set such that, when the second electric power is supplied to the glow plug and the temperature of the glow plug becomes saturated, the temperature of the glow plug becomes equal to the target temperature; and the first electric power is greater than the second electric power.

Notably, the "first electric power" is not necessarily constant. For example, the first electric power may change stepwise or continuously. In the case where the first electric power changes stepwise or continuously, the phrase "the first electric power is greater than the second electric power" means that the average value of electric power in the first energization period is greater than the average value of the second electric power in the first energization period.

According to the above-described configuration 1, the first electric power is supplied to the glow plug in the first energization period, the first electric power being greater than the second electric power which causes the glow plug to finally become saturated at the target temperature. Accordingly, the resistance of the glow plug (the sum of the resistance of the heating resistor and the respective resistances of the control coil, the center rod, and a power supply harness connected to the glow plug) can be raised rapidly with greater reliability, whereby the resistance of the glow plug can be caused to become saturated in a short period of time. Thus, the resistance of the glow plug at the target temperature (that is, the pre-correction target resistance) can be acquired within a short period of time, whereby the time required for calibration can be greatly shortened.

Configuration 2. The energization control apparatus for a glow plug according to the above-mentioned configuration 1, wherein the first energization period continues at least until the resistance of the glow plug exceeds a predetermined maximum pre-correction target resistance.

Notably, the "maximum pre-correction target resistance" refers to the maximum value of the pre-correction target resistance which is assumed for glow plugs of the same model number.

According to the above-described configuration 2, the period in which the first electric power is supplied to the glow plug (first energization period) is set such that the supply of the first electric power continues until the resistance of the glow plug exceeds the maximum pre-correction target resistance. That is, when the relatively large first electric power is applied to the glow plug, a case may arise where the resistance of the glow plug does not increase commensurate with its temperature. However, by means of setting the first energization period as described in the configuration 2, the resistance of the glow plug can be rapidly increased with greater reliability. As a result, the action and effects provided by the above-described configuration 1 are attained more reliably.

Configuration 3. The energization control apparatus for a glow plug according to the above-mentioned configuration 1 or 2, wherein the first electric power is set such that, when the first electric power is supplied to the glow plug and the temperature of the glow plug becomes saturated, the temperature of the glow plug becomes equal to or lower than a heat-resistance temperature of the glow plug.

According to the above-described configuration 3, breakage of the glow plug, which would otherwise occur upon supply of the first electric power, can be prevented with greater reliability.

BRIEF DESCRIPTION OF THE DRAWINGS

FIG. 3 is a flowchart showing energization control performed when an engine key is turned on.

DESCRIPTION OF REFERENCE NUMERALS

Figure 1:
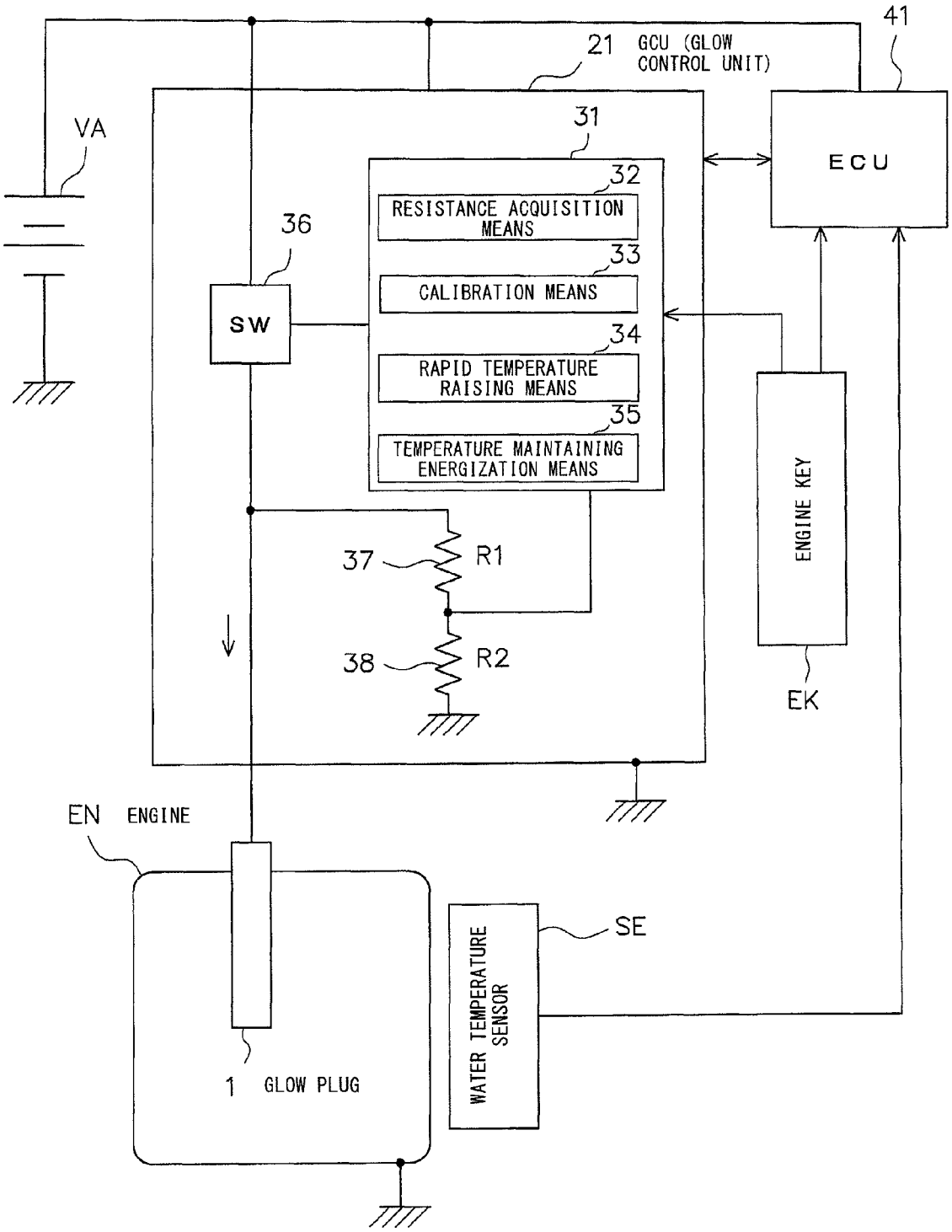
FIG. 1 is a block diagram showing the configuration of a system in which the supply of electric current to a glow plug is controlled by a glow control unit (GCU).

Reference numerals used to identify various features in the drawings include:

1: glow plug
21: GCU (glow control unit)
33: calibration means
EN: engine

DETAILED DESCRIPTION OF THE PREFERRED EMBODIMENTS

An embodiment of the invention will now be described with reference to the drawings. However, the present invention should not be construed as being limited thereto. A glow control unit (GCU) 21, which serves as an energization control apparatus, is used to control energization of a glow plug 1, to thereby assist startup of a diesel engine (hereinafter referred to as the "engine") EN of an automobile and to improve operation stability of the engine EN.

Before the description of the GCU 21, the structure of the glow plug 1, which is controlled by the GCU 21, will first be described briefly.

Figure 9A:
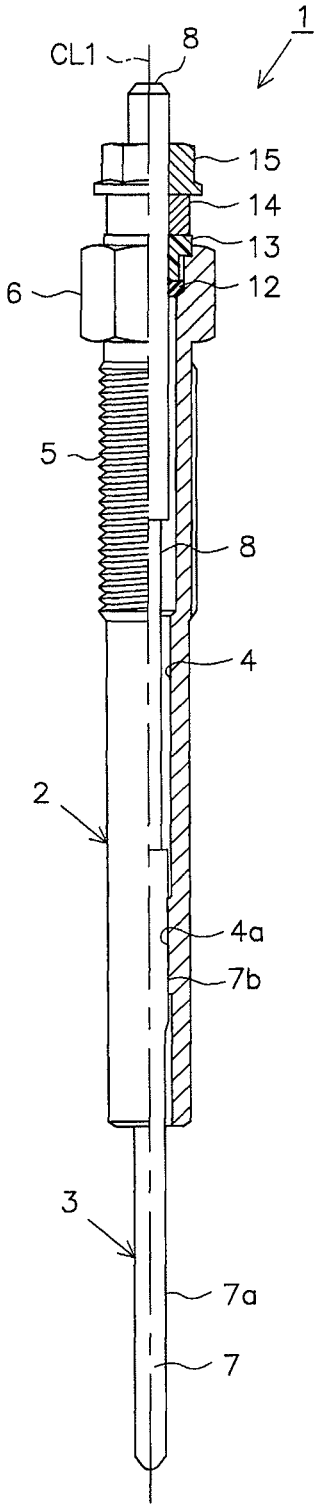
FIG. 9A is a partially cutaway front view of a glow plug.
Figure 9B:
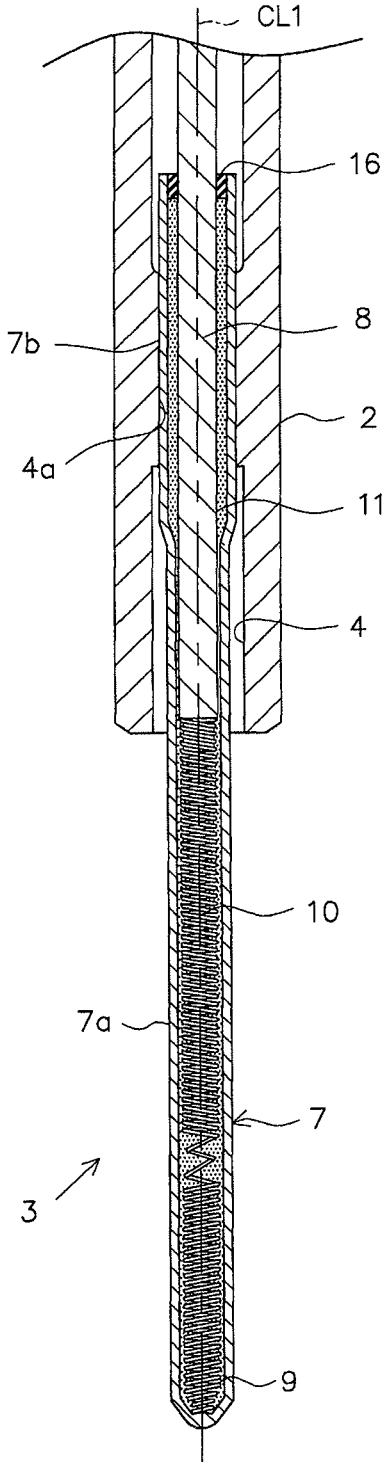
FIG. 9B is a partial enlarged cross-sectional view of a front end portion of the glow plug.

As shown in FIGS. 9A and 9B, the glow plug 1 includes a tubular metallic shell 2, and a sheath heater 3 attached to the metallic shell 2.

The metallic shell 2 has an axial hole 4 extending through the metallic shell 2 in the direction of an axis CL1. The metallic shell 2 also has, on its outer circumferential surface, a screw portion 5 for attachment to the engine EN, and a tool engagement portion 6, which has a hexagonal cross section and with which a tool such as a torque wrench, is engaged.

The sheath heater 3 includes a tube 7 and a center rod 8 united together in the direction of the axis CL1.

The tube 7 is a cylindrical tube mainly formed of iron (Fe) or nickel (Ni) and having a closed front end. The rear end of the tube 7 is sealed by an annular rubber member 16 disposed between the rear end of the tube 7 and the center rod 8. A heating coil 9 and a control coil 10 are disposed inside the tube 7 together with insulating power 11, such as magnesium oxide (MgO). The heating coil 9 is connected to the front end of the tube 7, and the control coil 10 is connected in series to the rear end of the heating coil 9.

The heating coil 9 is formed, for example, from a heat resistant wire made of a Fe-chromium (Cr)-aluminum (Al) alloy. Meanwhile, the control coil 10 is formed, for example, from a heat resistant wire containing Ni as a main component. Notably, of the heating coil 9 and the control coil 10, at least the heating coil 9 changes in resistance with its own temperature such that the resistance has a positive correlation with the temperature.

Through swaging or the like, a small diameter portion 7*a* for accommodating the heating coil 9, etc., is formed at a front end portion of the tube 7, and a large diameter portion 7*b*, which is larger in diameter than the small diameter portion 7*a*, is formed rearward of the small diameter portion 7*a*. The large diameter portion 7*b* is press-fitted into a small diameter portion 4*a* of the axial hole 4 of the metallic shell 2, whereby the tube 7 is held in a state in which the tube 7 projects from the front end of the metallic shell 2.

The center rod 8 extends through the axial hole 4 of the metallic shell 2. The front end of the center rod 8 is inserted into the tube 7, and is electrically connected to the rear end of the control coil 10. The rear end of the center rod 8 projects from the rear end of the metallic shell 2. At a rear end portion of the metallic shell 2, an O-ring 12 formed of rubber or the like, an insulating bushing 13 formed of resin or the like, a holding ring 14 which prevents the insulating bushing 13 from coming off, and a nut 15 for connecting an electric current supply cable are fitted onto the center rod 8 in this order from the front end side.

Next, the glow control unit (GCU) 21, which is the feature of the present invention, will be described.

FIG. 1 is a block diagram showing the configuration of a system in which the supply of electric current to the glow plug 1 is controlled by the GCU 21. Notably, in FIG. 1, the glow plug 1 is shown as being single in number. However, in actuality, the engine EN has a plurality of cylinders. Therefore, the glow plug 1 and a switch 36 described below are provided for each cylinder. Furthermore, although the GCU 21 independently performs the energization control for the individual glow plugs 1, the control method is the same among the glow plugs 1. Accordingly, in the following, the energization control which the GCU 21 performs for a certain one glow plug 1 will be described.

The GCU 21 operates while using electric power supplied from a battery VA, and includes a microcomputer 31 composed of a CPU, ROM, RAM, etc.

The microcomputer 31 executes various programs, such as an energization control program. A signal representing whether an engine key EK is on or off is input to the microcomputer 31. At the time of startup of the CPU, the CPU performs initialization (so-called initialization processing, including clearing of internal registers and the RAM, and setting of respective initial values to various flags and counters).

In addition, the switch 36 is provided in the GCU 21. The GCU 21 controls the supply of electric current to the glow plug 1 through pulse width modulation (PWM) control, and the switch 36 starts and stops the supply of electric current to the glow plug 1 in accordance with instructions from the microcomputer 31.

Moreover, the microcomputer 31 includes resistance acquisition means 32 for measuring the resistance of the glow plug 1 (notably, the "resistance of the glow plug 1" is the sum of the resistance of the heating coil 9, the respective resistances of the control coil 10, the center rod 8, a power supply harness connected to the glow plug 1, and the resistance of the metallic shell 2). In the present embodiment, the resistance of the glow plug 1 is acquired as follows. That is, the switch 36 is configured to operate an FET (field effect transistor) having a current detection function via an NPN-type transistor or the like. Also, the microcomputer 31 is connected to the power supply terminal of the glow plug 1 via voltage division resistors 37 and 38. Accordingly, the microcomputer 31 can acquire current flowing from the FET to the glow plug 1 and voltage produced through voltage division of the voltage applied to the glow plug 1. The resistance acquisition means 32 can calculate the voltage applied to the glow plug 1 on the basis of the voltage input to the microcomputer 31, and obtain the resistance of the glow plug 1 from the applied voltage and the current flowing through the glow plug 1.

Notably, a relatively inexpensive FET having no current detection function may be used as the switch 36. In this case, a shunt resistor is provided, for example, between the switch 36 and the glow plug 1, and current flowing through the shunt resistor is measured so as to measure the resistance of the glow plug 1. Alternatively, a resistor for current detection may be provided in parallel to the switch 36. In this case, when the supply of electric current to the glow plug 1 is stopped, a predetermined current is supplied to the glow plug 1 via the resistor, and the resistance of the glow plug 1 is calculated on the basis of a voltage obtained through voltage division.

In addition, the GCU 21 is connected to an electronic control unit (ECU) 41 of the automobile via a predetermined communication means (e.g., controller area network (CAN), etc.). The ECU 41 receives a measurement value from a water temperature sensor SE, which measures the temperature of cooling water of the engine EN. The GCU 21 acquires the temperature of the cooling water (water temperature information) from the ECU 41 as information regarding the environmental temperature. Notably, the GCU 21 may be configured to acquire the water temperature information directly from the water temperature sensor SE, without acquiring the water temperature information from the ECU 41.

Furthermore, the microcomputer 31 includes calibration means 33. The calibration means 33 obtains and sets a pre-correction target resistance R0 of the glow plug 1 so as to perform correction/adjustment on the correlation between the temperature and resistance of the glow plug 1, for the purpose of controlling the supply of electric current to the glow plug 1. Notably, the "pre-correction target resistance $R_0$" refers to a resistance based on which a resistance (target resistance $R_{TAR}$) of the glow plug 1 corresponding to a temperature (target temperature) at which the glow plug 1 is to be maintained (held) is calculated in temperature-maintaining energization, as described below. In addition to the pre-correction target resistance $R_0$, the calibration means 33 obtains information representing water temperature when the pre-correction target resistance $R_0$ is obtained, and stores the obtained pre-correction target resistance $R_0$ and the water temperature information in the RAM.

The pre-correction target resistance $R_0$ (calibration) is set when exchange of the glow plug 1 is detected or when the pre-correction target resistance $R_0$ assumes a cleared value. In order to avoid the influence of various disturbances, such as a swirl and cooling by fuel injection, calibration is performed when the engine EN is not operated. During calibration, since the glow plug 1 is caused to reach a temperature approximately equal to a temperature at the time of startup of the engine EN, the glow plug 1 consumes a large amount of electric power. Therefore, calibration is performed when the engine EN is operated and then stopped; i.e., when the battery VA is expected to have been charged.

Notably, exchange of the glow plug 1 is detected as follows. That is, when the engine EN is stopped, the GCU 21 supplies electric current to the glow plug 1 at short intervals, and periodically acquires the resistance of the glow plug 1 from the voltage applied to the glow plug 1 at that time and the current flowing through the glow plug 1. The GCU 21 determines, through comparison, whether or not the acquired resistance is greater than a predetermined threshold value (exchange determination value). When the glow plug 1 is removed from the engine EN, the glow plug 1 is not present in the circuit of the GCU 21. Therefore, no current flows through the glow plug 1, and a very large resistance is acquired. Therefore, when the resistance of the glow plug 1 is greater than the exchange determination value, the GCU 21 determines that the glow plug 1 has been removed; that is, the glow plug 1 has been exchanged. Meanwhile, when the resistance of the glow plug 1 is equal to or less than the exchange determination value, the GCU 21 determines that the glow plug 1 has not been exchanged. Notably, the method for detecting exchange of the glow plug 1 is not limited to the above-described method, and other methods may be used. For example, a method can be employed in which a user inputs a signal indicating exchange of the glow plug 1 to the GCU 21 via predetermined input means.

Setting of the pre-correction target resistance $R_0$ (calibration) is performed as follows. Electric current is first supplied to a glow plug which serves as a reference such that the surface temperature of its tube becomes saturated at a target temperature, and the cumulative amount of electric power supplied at that time (cumulative electric energy) is obtained. Then, at the time of calibration, electric current is supplied to a glow plug to be calibrated such that this cumulative electric energy is supplied to the glow plug 1 (hereinafter the supply of electric current to the glow plug 1 at the time of calibration will be referred to as "correction energization"), the resistance of the glow plug 1 at that time (when the above-mentioned cumulative electric energy is supplied) is obtained, and set as the pre-correction target resistance $R_0$. If resistance control is performed for each glow plug 1 on the basis of the corresponding pre-correction target resistance $R_0$, correction can be performed such that deviation among the plurality of glow plugs 1 is eliminated.

Also, in the present embodiment, when the correction energization is performed, electric power is supplied to the glow plug 1 as follows. That is, a relatively large first amount of electric power (e.g., 45 W) (hereinafter called "first electric power") is supplied to the glow plug 1 in a predetermined first energization period T1 (e.g., 25 sec) from the start of the correction energization. After the end of the first energization period $T_1$, a predetermined second amount of electric power (e.g., 40 W) (hereinafter called "second electric power") is supplied to the glow plug 1 in a predetermined second energization period $T_2$ (e.g., 15 sec). Notably, the time elapsed from the start of the correction energization is measured by an unillustrated timer.

The "first electric power" is greater than the second electric power, and is set such that, when the first electric power is supplied to the glow plug 1 and the temperature of the glow plug 1 becomes saturated, the temperature of the glow plug 1 becomes equal to or lower than a heat-resistance temperature (e.g., 1350° C.) of the glow plug 1. The "second electric power" is set such that, when the second electric power is supplied to the glow plug 1 and the temperature of the glow plug 1 becomes saturated, the temperature of the glow plug 1 becomes equal to a target temperature (e.g., 1200° C.).

The "first energization period $T_1$" is a period of time required for the resistance R of the glow plug 1 to exceed the maximum value of the pre-correction target resistance $R_0$ assumed for glow plugs of the same model number (maximum pre-correction target resistance $R_{0MAX}$) when the first electric power is continuously supplied to the glow plug 1. Accordingly, by supplying the first electric power to the glow plug 1 in the first energization period $T_1$, the resistance R of the glow plug 1 can be made greater than the finally obtained pre-correction target resistance $R_0$.

Notably, the "first energization period $T_1$" can be obtained as follows. That is, of glow plugs of the same model number which are assumed to have the same industrial performance, a plurality of glow plugs whose characteristics vary are selected, and calibration is performed for the plurality of glow plugs so as to supply the first electric power and then the second electric power thereto. Subsequently, the pre-correction target resistance of each glow plug is measured (notably, the first electric power is supplied to each glow plug until the resistance of the glow plug exceeds the maximum pre-correction target resistance). At the time of supply of the first electric power, a time at which the resistance of each glow plug exceeds the corresponding pre-correction target resistance is recorded for each glow plug. The maximum one of the times recorded for the plurality of glow plugs can be used as the "first energization period $T_1$."

As described the above, setting the first electric power to be larger than the second electric power but not to be excessively large with respect to the second electric power, the resistance of the glow plug can be caused to become saturated for a short period of time while preventing breakage of the glow plug. Thus, an amount of the first electric power may be defined considering the durability of a glow plug. For example, the first electric power may be larger than the second electric power by about 5 W.

Furthermore, the time required for calibration can be assuredly shortened by defining the first energization period $T_1$ as described above.

The "second energization period $T_2$" is set such that, when the second electric power is supplied to the glow plug 1 over the second energization period $T_2$, the electric energy finally supplied to the glow plug 1, including the electric energy supplied thereto during the first energization period $T_1$, becomes equal to the above-described predetermined cumulative electric energy.

Furthermore, the microcomputer 31 includes rapid temperature raising means 34 and temperature maintaining energization means 35.

The rapid temperature raising means 34 supplies a large amount of electric power to the glow plug 1 when the engine key EK is turned on, to thereby cause the glow plug 1 to quickly reach a predetermined target temperature (in the present embodiment, 1200° C.).

In this rapid temperature raising energization, a curve representing the relation between electric power supplied to the glow plug 1 and elapsed time is rendered coincident with a previously prepared reference curve, whereby the glow plug 1 is caused to reach the target temperature rapidly (e.g., within about 2.0 sec) irrespective of the characteristics of the glow plug 1. Specifically, by making use of a table or relational expression which shows the previously determined reference curve, an amount of electric power to be supplied at each point in time is obtained in accordance with the time elapsed from the start of energization. A voltage to be applied to the glow plug 1 is obtained from the relation between the current flowing through the glow plug 1 and the amount of electric power to be supplied at each point, and the voltage applied to the glow plug 1 is controlled through PWM control. As a result, the supply of electric power is performed such that the curve representing the relation between the supplied electric power and elapsed time coincides with the reference curve, whereby the glow plug 1 generates heat in accordance with the cumulative amount of electric power supplied up to each point in time during the temperature raising process. Accordingly, upon completion of supply of electric power along the reference curve, the glow plug 1 reaches the target temperature within a time determined by the reference curve.

The temperature maintaining energization means 35 performs energization for maintaining the glow plug 1 at the target temperature for a predetermined period of time after the glow plug 1 has reached the target temperature. Through performance of the temperature maintaining energization of the glow plug 1, before startup of the engine EN, a state can be established in which the engine EN can be started at any time. Furthermore, after startup of the engine EN, the warming of gas within a combustion chamber of the engine is accelerated. Therefore, generation of diesel knocking can be prevented, generation of noise and white smoke can be suppressed, and emission of an HC component can be suppressed.

In addition, during the temperature maintaining energization, the supply of electric current to the glow plug 1 is controlled on the basis of the difference between the resistance R of the glow plug 1 and the target resistance $R_{TAR}$. Notably, the "target resistance $R_{TAR}$" is a target resistance obtained by correcting the pre-correction target resistance $R_0$ of the glow plug 1 obtained through calibration in order to remove the influence of disturbances such as a change in water temperature, swirl produced in a combustion chamber, etc. In the temperature maintaining energization in the present embodiment, a control effective voltage V1 based on the difference $(R_{TAR}-R)$ is set through proportional-integral (PI) control. Subsequently, a duty ratio is calculated from the set control effective voltage $V_1$ and a voltage output from the GCU 21 to the glow plug 1 (controller output voltage), and the supply of electric current to the glow plug 1 is controlled in accordance with the duty ratio. Notably, for calculation of the duty ratio, the supply voltage of the battery VA may be used in place of the output voltage from the GCU 21.

In the present embodiment, the control effective voltage $V_1$ is set on the basis of an expression "$V_1=V_0+K\times\{(R_{TAR}-R)+(T_S/T_I)\times\Sigma(R_{TAR}-R)\}$." Notably, $V_0$ is a reference effective voltage; K is a proportional term coefficient; $T_I$ is an integral term coefficient; and $T_S$ is a sampling time. In the present embodiment, the coefficients K, $T_I$ and the time $T_S$ are set to predetermined values in advance. Also, the reference effective voltage $V_0$ is acquired on the basis of the set target temperature and from an expression (voltage-temperature relational expression) representing the relation between a temperature of the glow plug 1 in a disturbance-free state and an effective voltage to be applied to the glow plug 1 so as to cause the glow plug 1 to reach that temperature. Notably, the voltage-temperature relational expression represents an approximated first-order correlation between the temperature of the glow plug and the reference effective voltage $V_0$, and, in the present embodiment, is prepared in advance.

The correction for change in water temperature is performed as follows. That is, on the basis of a previously set correction expression (water temperature correction expression) showing the relation between water temperature and correction value, a correction value $R_1$ for water temperature change is calculated from the difference between a water temperature measured by the water temperature sensor SE and a water temperature stored at the time of calibration. The obtained correction value $R_1$ for water temperature change is added to the pre-correction target resistance $R_0$, whereby the pre-correction target resistance $R_0$ is corrected for the influence of water temperature change. Notably, the water temperature correction expression can be specified for each engine type (in other words, the water temperature correction expression does not change depending on the type of the plug), and represents a predetermined first-order correlation between water temperature and correction value $R_1$ for water temperature change.

In the present embodiment, the correction for disturbances such as swirl is performed as follows. That is, on the basis of a swirl correction expression set in advance, a correction value $R_2$ for swirl is calculated from the difference between the average value of effective voltage applied to the glow plug 1 within a predetermined period of time (average effective voltage) and a standard effective voltage set for each glow plug type (model number) as an effective voltage to be applied so as to cause the glow plug 1 to reach the target temperature. The calculated correction value $R_2$ for swirl is added to the pre-correction target resistance $R_0$, whereby the pre-correction target resistance $R_0$ corrected for the influences of disturbances such as swirl is obtained.

Notably, the swirl correction expression is obtained through a bench test in which the engine is solely operated, while engine speed, load, water temperature, etc., are changed in various manners. The swirl correction expression represents the relation between the difference (effective voltage difference) obtained by subtracting the standard effective voltage from the average effective voltage, and the correction value $R_2$ for swirl which corresponds to the difference (that is, which corresponds to the difference between the resistance of the glow plug when the engine is operated and the resistance of the glow plug when the engine is not operated). In particular, in the present embodiment, in view of the empirically-obtained knowledge that the effective voltage difference and the correction value $R_2$ for swirl have a first-order correlation therebetween, the correction expression is determined as follows. A point at which the correction value $R_2$ for swirl becomes zero when the average effective voltage is equal to the standard effective voltage is used as a reference point, and a linear expression is derived from coordinates of several points which are obtained by means of changing engine speed, load, etc., and which represent the relation between the effective voltage difference and the correction value $R_2$ for swirl. The thus-derived linear expression is used as a correction expression. Notably, this correction expression is commonly used for energization control of a plurality of glow plugs 1. Furthermore, in the present embodiment, a value corresponding to the type of the spark plug 1 is set in advance as the standard effective voltage.

Notably, after the rapid temperature raising energization but before the temperature maintaining energization, electric power may be supplied to the glow plug 1 such that the resistance of the glow plug 1 becomes saturated at the target resistance RTAR after elapse of a predetermined time (e.g., 20 sec). In this case, the temperature of the glow pug 1 can be maintained at the target temperature with greater stability.

Figure 2:
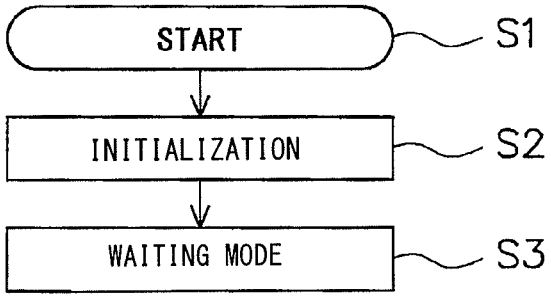
FIG. 2 is a flowchart showing a main routine of a GCU operation program.
Figure 3:
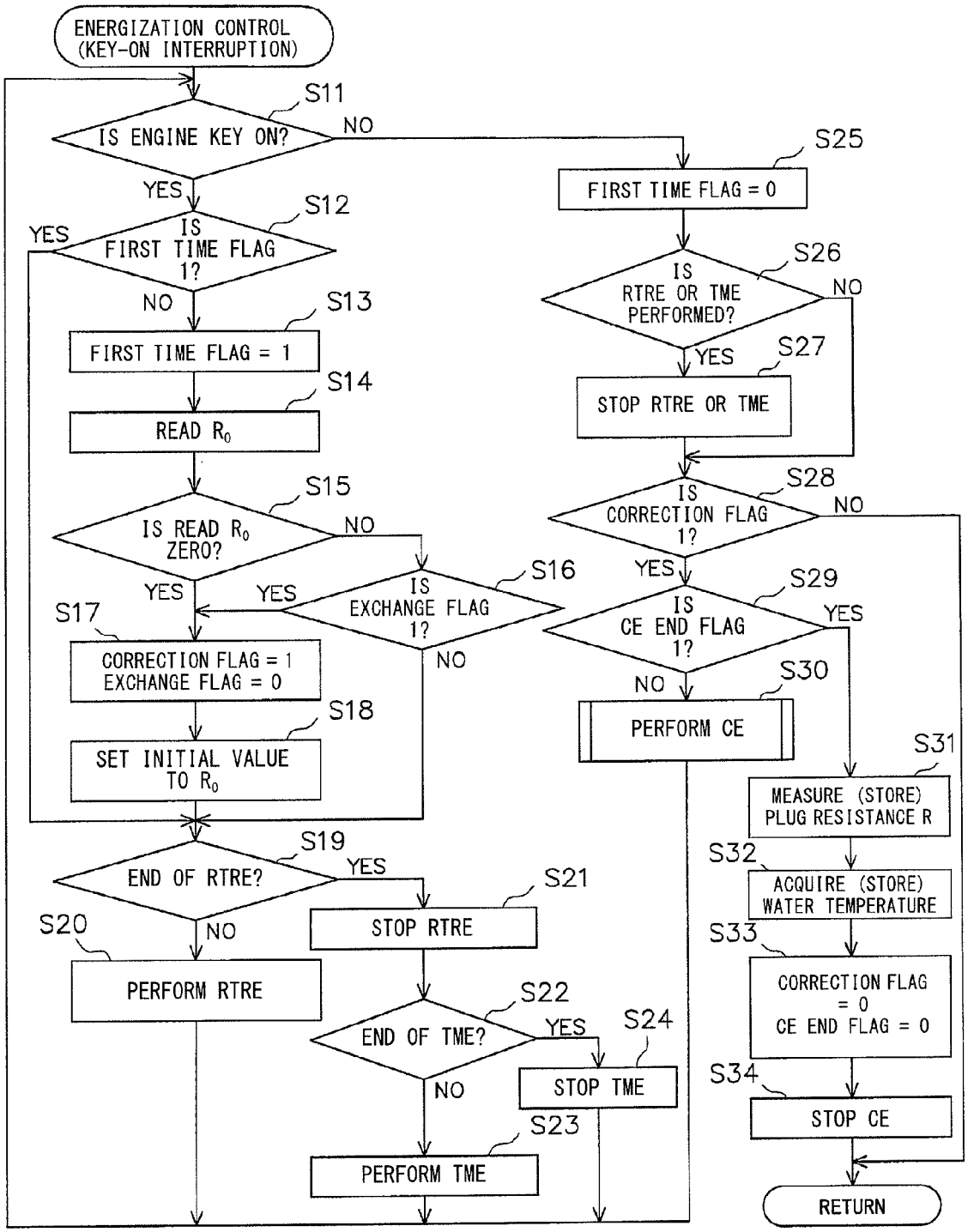
Figure 4:
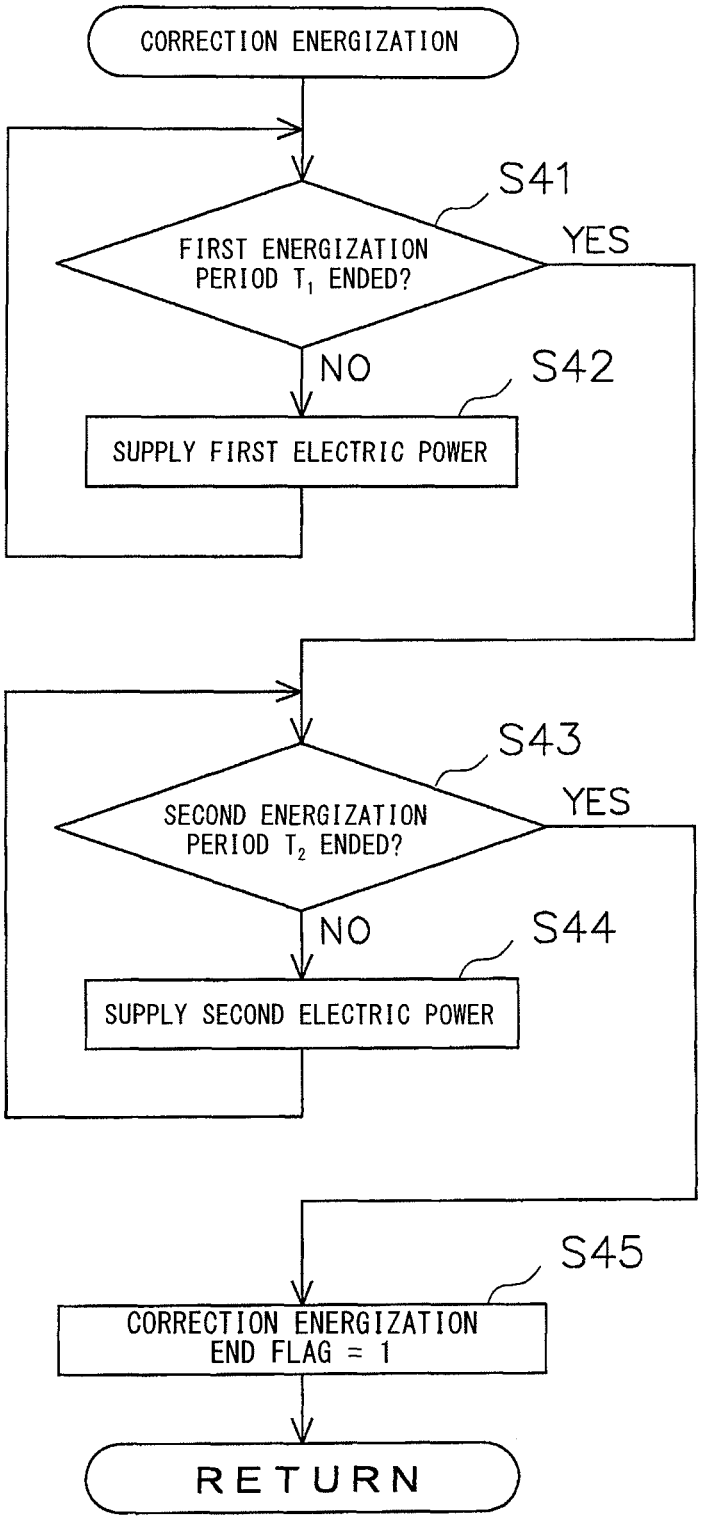
FIG. 4 is a flowchart showing processing for correction energization.

Next, a specific example of energization control performed by the GCU 21 for the glow plug 1 will be described in accordance with the flowcharts of FIGS. 2 to 4. FIG. 2 is a flowchart showing a main routine of a GCU operation program. FIG. 3 is a flowchart showing energization control performed through interruption when the engine key EK is on. FIG. 4 is a flowchart showing processing performed during calibration.

First, as shown in FIG. 2, the GCU 21 (the microcomputer 31) starts in S1 upon connection of the battery VA to the GCU 21 (for example, when the GCU 21 and the battery VA are connected together after assembly of the vehicle or when the battery VA is connected again after being removed at the time of exchange of the glow plug 1). In S2 subsequent thereto, the microcomputer 31 performs initialization processing, including resetting of RAM and resetting of the pre-correction target resistance R0.

Next, in S3, the microcomputer 31 enters a waiting mode (power-saving mode). In this waiting mode (S3), exchange of the glow plug 1 is detected. When exchange of the glow plug 1 is detected, an exchange flag described below is set to 1.

In the waiting mode (S3), the microcomputer 31 waits until an interruption signal is input to the microcomputer 31 as a result of the engine key EK being turned on.

When the engine key EK is turned on and an interruption signal is input to the microcomputer 31, the microcomputer 31 enters a normal mode, and, as shown in FIG. 3, the microcomputer 31 determines whether or not the engine key EK is on, from a voltage of a terminal of the microcomputer 31 connected to the engine key EK (S11). When the engine key EK is on, the microcomputer 31 proceeds to S12.

In S12, the microcomputer 31 checks a first time flag. This "first time flag" is used as a determination condition for executing specific initial setting processing (S13 to S18 described below) only when the engine key EK is turned from off to on. The initial setting processing is a portion of a series of processing steps of the energization control program executed repeatedly when the engine key EK is on. In the initial state, the first time flag is set to 0.

When the first time flag indicates that the condition is not satisfied (0) (S12; No), the microcomputer 31 sets the first time flag to 1 in S13 so that the microcomputer 31 can skip from S12 to S19 in the next and subsequent execution cycles.

Subsequently, the microcomputer 31 reads the pre-correction target resistance $R_0$ (reference to a value) (S14). When the pre-correction target resistance $R_0$ is 0 (S15; Yes: for example, in the case where the RAM storing the re-correction target resistance $R_0$ is cleared, for example, at the time of exchange of the battery VA or at the time of shipment), or when the pre-correction target resistance $R_0$ is not 0 (S15; No) but the exchange flag is set to 1 (S16; Yes); i.e., when exchange of the glow plug 1 is detected, a correction flag is set to 1 so as to perform calibration after the engine EN is stopped (S17). Notably, in S17, the exchange flag is set to 0 in order to prevent the calibration from being performed a plurality of times in association with the exchange of the glow plug 1. When the correction flag is set to 1 (S17), the pre-correction target resistance $R_0$ stored in the RAM at this point in time may be that of the exchanged old glow plug 1. Therefore, an initial value is set to the pre-correction target resistance $R_0$ (S18).

Notably, the "exchange flag" is a flag which is set to 1 when exchange of the glow plug 1 is detected. The "correction flag" is a flag used to determine whether to perform calibration. The "initial value of the pre-correction target resistance $R_0$" is set such that even when each of other glow plugs having different characteristics is resistance-controlled by use of a target resistance calculated from that initial value, none of the glow plugs cause overshooting (excessive rise of temperature).

Next, until the glow plug 1 reaches a predetermined target temperature after the start of energization of the glow plug 1 (S19; No), energization for rapidly raising the temperature of the glow plug 1 (rapid temperature raising energization) is performed (S20).

After that, the microcomputer 31 returns to S11, and repeats the processing of S11 to S20, until the rapid temperature raising energization ends, to thereby continue the rapid temperature raising energization of the glow plug 1. Notably, since the first time flag has been set to 1 in S13, in the next and subsequent execution cycles the microcomputer 31 proceeds from S12 to S19 without performing the processing of S13 and S18.

In the present embodiment, the microcomputer 31 determines in S19 that the rapid temperature raising energization must be ended, when one of the following three conditions is satisfied. The first condition is such that a predetermined period (e.g., 3.3 sec) has elapsed after the start of the rapid temperature raising energization. The second condition is such that the cumulative electric energy supplied to the glow plug 1 has reached a predetermined electric energy (e.g., about 214 J). In these cases, since the temperature of the glow plug 1 is considered to have reached the target temperature, the rapid temperature raising energization is ended. The third condition is such that the resistance R of the glow plug 1 measured by the microcomputer 31 has reached a predetermined resistance (for example, 780 mΩ). That is, in the case where the temperature of the glow plug 1 is already somewhat high at the time when the supply of electric power to the glow plug 1 is started (e.g., the case where re-energization is performed before the glow plug has not yet been cooled sufficiently after the previous energization has ended), the supply of electric power is stopped when the resistance R of the glow plug 1 reaches the predetermined resistance. This operation can prevent excessive temperature rise of the glow plug 1.

When one of the above-mentioned end conditions is satisfied, while the rapid temperature raising energization is continued through repetition of S11 to S20, and the microcomputer 31 determines that the rapid temperature raising energization has ended (S19; Yes), the microcomputer 31 stops the rapid temperature raising energization of the glow plug 1 (S21). In the present embodiment, after the rapid temperature raising energization, temperature maintaining energization (so-called after glow) is performed.

In the temperature maintaining energization, as described above, a duty ratio is calculated on the basis of the control effective voltage V1 obtained from the target resistance $R_{TAR}$ and the voltage output from the GCU 21 to the glow plug 1 (controller output voltage); and the supply of electric current to the glow plug 1 is controlled in accordance with the duty ratio. After that, the microcomputer 31 continues the temperature maintaining energization (S23) until a condition for ending the temperature maintaining energization is satisfied (that is, the result of determination in S22 becomes "Yes").

When the microcomputer 31 determines that the temperature maintaining energization has ended after the continuation of the temperature maintaining energization (S22; Yes), the microcomputer 31 stops the supply of electric power to the glow plug 1 (S24). Notably, the condition for ending the temperature maintaining energization may be the passage of a predetermined time (e.g., 180 sec) after the start of the temperature maintaining energization.

When the engine key EK is turned off and operation of the engine EN is stopped (S11; No), the microcomputer 31 resets the first time flag (S25) so as to perform the processing of S3, etc., at the next operation of the engine EN. In the case where the rapid temperature raising energization or the temperature maintaining energization for the glow plug 1 is being performed when the engine key EK is turned off (S26; Yes), the microcomputer 31 stops the supply of electric current to the glow plug 1 (S27).

Next, in S28, the microcomputer 31 checks whether or not the correction flag is set to 1. When the correction flag is set to 1 (S28; Yes), the microcomputer 31 performs calibration for the glow plug 1.

As described above, in the calibration, an amount of cumulative electric energy which allows the glow plug 1 to reach the target temperature is supplied to the glow plug 1, and the resistance of the glow plug 1 at the time when increases in the temperature and resistance of the glow plug 1 become saturated is obtained as the pre-correction target resistance $R_0$. In the present embodiment, from the start of the calibration to a point in time when the correction energization end flag is set to 1 (the result of determination in S29 becomes "Yes"), the microcomputer 31 performs the correction energization; i.e., supplies electric power to the glow plug 1 such that the finally supplied electric energy becomes equal to a predetermined amount of cumulative electric energy (S30). Notably, the "correction energization end flag" is used for determining the end of the correction energization, and is set to 0 in an initial state. The correction energization is described in detail below.

When the correction energization end flag is set to 1 after the correction energization has been continued (S29; Yes), the microcomputer 31 proceeds to S31. At this time, since the glow plug 1 has reached the target temperature, the resistance R of the glow plug 1 at that time is obtained, and is stored in the RAM as the pre-correction target resistance $R_0$ (S31). Furthermore, the microcomputer 31 acquires from the ECU 41 information representing the water temperature detected by the water temperature sensor SE, and stores the water temperature information in the RAM along with the pre-correction target resistance $R_0$ (S32). Subsequently, since the calibration is ended, the microcomputer 31 resets the correction flag and the correction energization end flag (S33), and stops the supply of electric current to the glow plug 1 to thereby end the correction energization (S34). After that, the microcomputer 31 enters the waiting mode (power-saving mode).

Figure 5A:
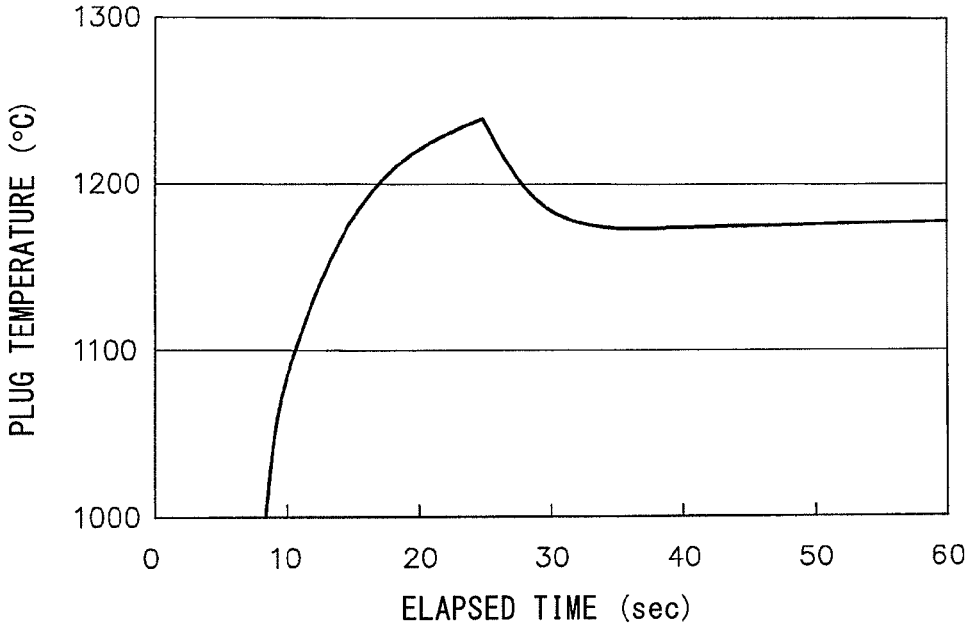
FIG. 5A is a graph showing a change in temperature of a glow plug during calibration.
Figure 5B:
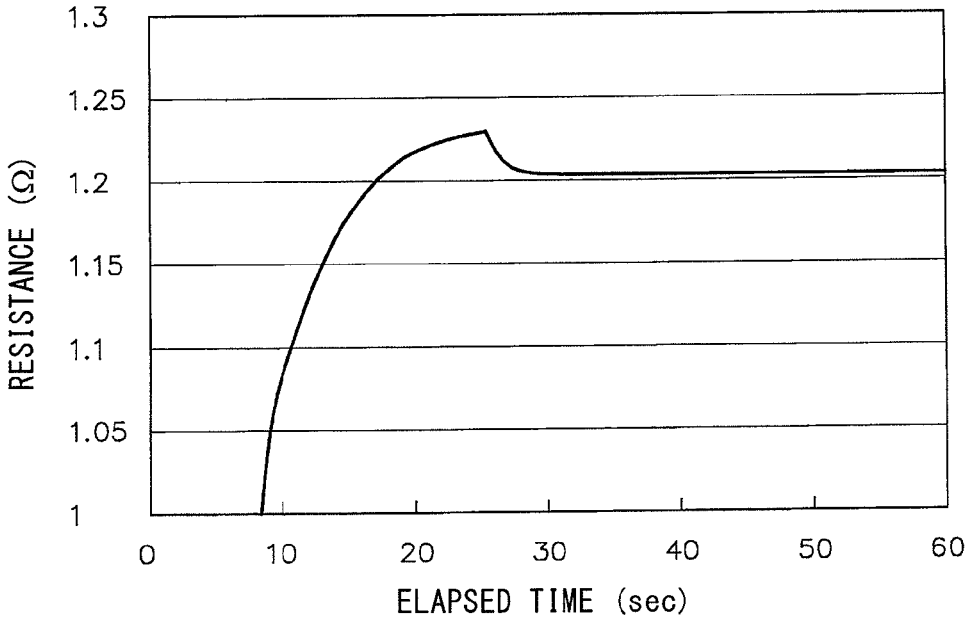
FIG. 5B is a graph showing a change in resistance of the glow plug during calibration.

Next, the correction energization performed at the time of calibration will be described. As shown in FIG. 4, the microcomputer 31 first checks in S41 whether or not the first energization period T1 having started from the start of energization ends, and supplies the first electric power to the glow plug 1 (S42) until the first energization period $T_1$ ends (the result of the determination in S41 becomes "Yes"). Therefore, as shown in FIGS. 5A and 5B, the temperature and resistance of the glow plug 1 increase rapidly (notably, FIGS. 5A and 5B are provided for facilitating understanding of the present invention, and, in actuality, the temperature of the glow plug 1 is not measured during the correction energization).

Upon completion of the first energization period $T_1$, in which the first electric power has been supplied to the glow plug 1 (S41; Yes), the microcomputer 31 checks in S43 whether or not the second energization period $T_2$ following the first energization period $T_1$ has ended. Notably, at the end of the first energization period $T_1$, the temperature of the glow plug 1 exceeds the target temperature, and the resistance R of the glow plug 1 exceeds the maximum pre-correction target resistance $R_{0MAX}$.

In the case where the second energization period $T_2$ following the first energization period $T_1$ has not yet reached its end (S43; No), the microcomputer 31 supplies second electric power to the glow plug 1 (S44) until the second energization period $T_2$ ends (the result of the determination in S43 becomes "Yes"). As described above, the second electric power is set such that, when the temperature of the glow plug 1 becomes saturated, the temperature of the glow plug 1 becomes equal to the target temperature. Therefore, the temperature and resistance of the glow plug 1 gradually decrease, and finally become stable when the glow plug 1 reaches the target temperature.

When the second energization period $T_2$ ends (S43; Yes), the microcomputer 31 sets the correction energization end flag so as to end the correction energization (S45). After that, in a state in which the glow plug 1 is stably maintained at the target temperature, as described above, in S31, the microcomputer 31 measures the resistance R of the glow plug 1, and sets (stores) it as the pre-correction target resistance $R_0$ of the glow plug 1.

As having been described in detail above, according to the present embodiment, the first electric power is supplied to the glow plug 1 in the first energization period $T_1$, the first electric power being greater than the second electric power which causes the glow plug 1 to finally become saturated at the target temperature. The first energization period $T_1$ is set such that the supply of the first electric power continues until the resistance R of the glow plug 1 exceeds the maximum pre-correction target resistance $R_{0MAX}$. Accordingly, the resistance R of the glow plug 1 can be rapidly raised with greater reliability, whereby the resistance of the glow plug 1 can be caused to become saturated in a short period of time. Thus, the resistance R of the glow plug 1 at the target temperature (that is, the pre-correction target resistance $R_0$) can be acquired within a short period of time, whereby the time required for calibration can be greatly shortened.

Also, the first electric power is set such that, when the first electric power is supplied to the glow plug 1 and the temperature of the glow plug 1 becomes saturated, the temperature of the glow plug 1 does not become equal to or lower than a heat-resistance temperature. Accordingly, breakage of the glow plug 1, which would otherwise occur upon supply of the relatively large first electric power, can be prevented more reliably.

Figure 6:
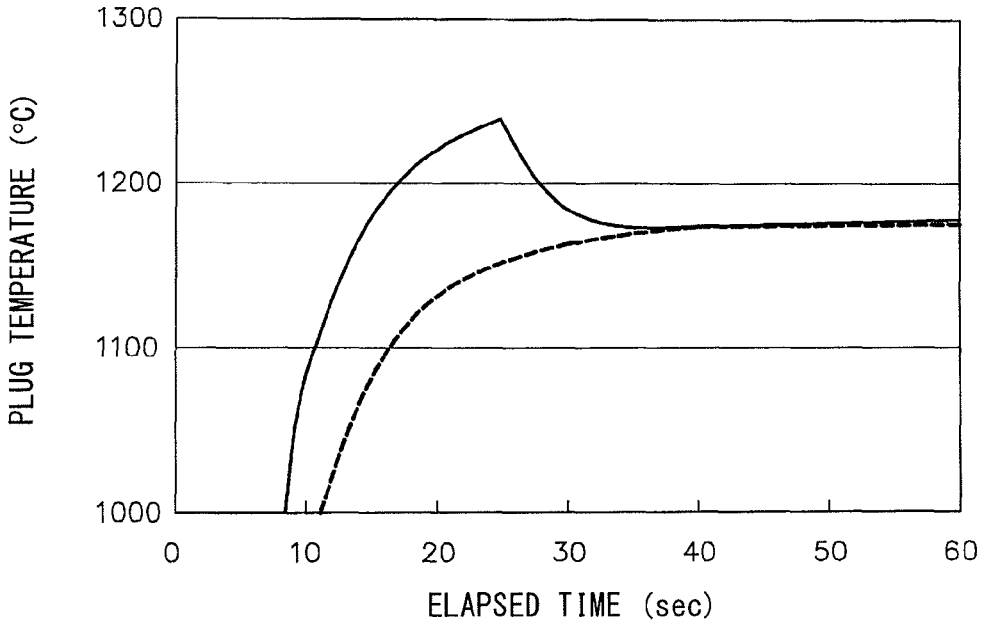
FIG. 6 is a graph showing a change in temperature of a glow plug when an energization control apparatus according to a comparative example is used, and a change in temperature of a glow plug when the energization control apparatus according to the present invention is used.
Figure 7:
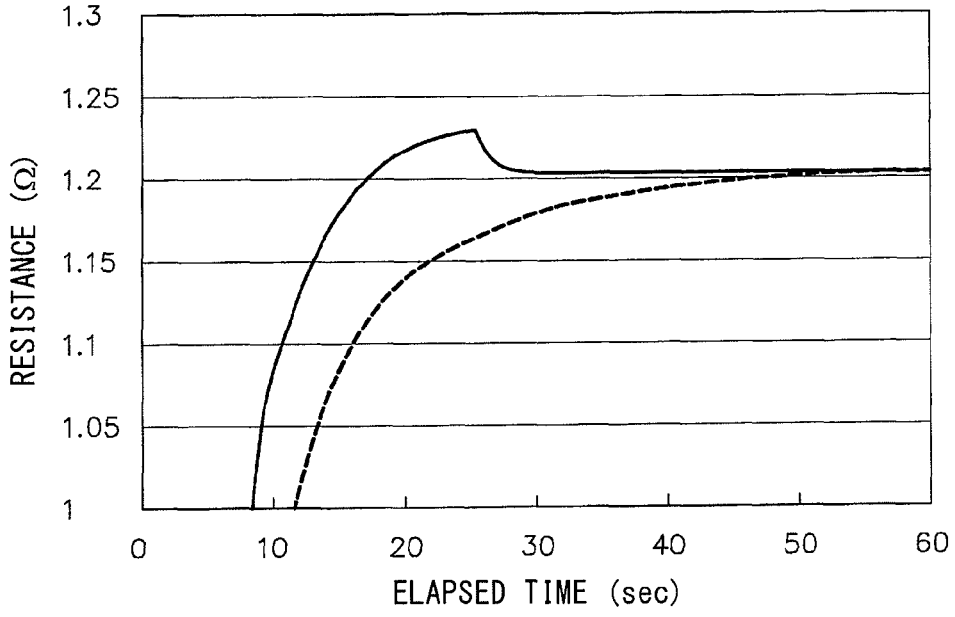
FIG. 7 is a graph showing a change in resistance of a glow plug when an energization control apparatus according to a comparative example is used, and a change in resistance of a glow plug when the energization control apparatus according to the present invention is used.
Figure 8:
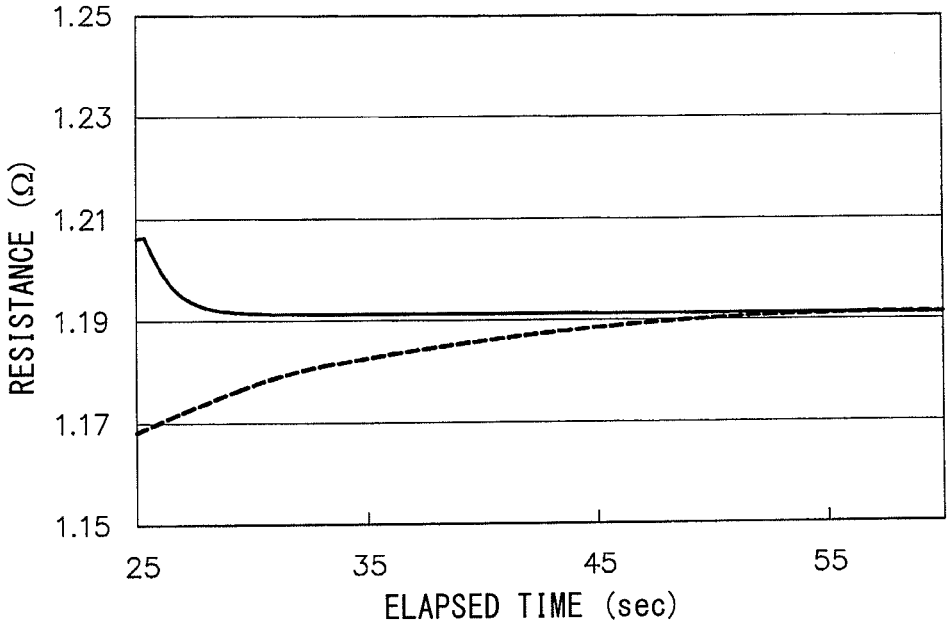
FIG. 8 is a graph showing a change in resistance of a glow plug, during a test, after elapse of 25 sec from the start of energization.

Next, in order to confirm the action and effects of the present embodiment, a test was carried out in which calibration was performed by use of two types of energization control apparatuses; i.e., an energization control apparatus (comparative example) which supplies constant electric power to a glow plug, and an energization control apparatus (the present invention) which supplies the first electric power to a glow plug in a first energization period, and a second electric power thereto after the first energization period. FIG. 6 shows a change in temperature of the glow plug in the test, and FIG. 7 shows a change in resistance of the glow plug during the test. FIG. 8 shows a change in resistance of the glow plug after elapse of 25 sec from the start of energization. Notably, in FIGS. 6 to 8, changes in temperature and resistance of the glow plug controlled by the energization control apparatus according to the comparative example are represented by broken lines, and changes in temperature and resistance of the glow plug controlled by the energization control apparatus according to the present invention are represented by solid lines. Notably, the battery voltage is 12 V.

As shown in FIG. 6, in terms of the time required for attaining a stable glow plug temperature, a large difference was not observed between the glow plug controlled by the energization control apparatus of the comparative example and the glow plug controlled by the energization control apparatus of the present invention. However, as shown in FIGS. 7 and 8, whereas the glow plug controlled by the energization control apparatus of the comparative example required about 60 sec to provide a stable resistance, the glow plug controlled by the energization control apparatus of the present invention required about 40 sec to provide a stable resistance. Conceivably, this improved performance is attained for the following reasons. Since the relatively large first electric power is supplied and the period in which the first electric power is supplied (first energization period) is set such that the supply of the first electric power continues until the resistance of the glow plug exceeds a predetermined maximum pre-correction target resistance, the resistance of the glow plug can be increased rapidly, whereby the time needed for saturation of the resistance of the glow plug can be shortened.

The results of the above-described test demonstrate that, according to the present invention, in calibration, the resistance of the glow plug can be rapidly saturated, and the time required for calibration can be greatly shortened.

Notably, the present invention is not limited to the details of the above-described embodiment, and may be practiced as follows. Needless to say, other application examples and modifications not illustrated below are also possible.

(a) In the above-described embodiment, the first electric power has a constant magnitude. However, the first electric power may be changed stepwise or continuously. For example, a relatively large electric power is supplied, as the first electric power, to a glow plug 1 in an initial stage of the first energization period $T_1$, and an electric power similar to that employed in the above-described embodiment as the first electric power is supplied from an intermediate stage of the first energization period $T_1$. In this case, the resistance of the glow plug 1 can be increased more rapidly, and the time required for calibration can be further shortened. However, when an excessively large electric power is supplied to the glow plug 1 in the initial stage of the first energization period $T_1$ (a stage in which the resistance R of the glow plug 1 is relatively low), excessive temperature rising (overshooting) of the glow plug 1 may occur. Accordingly, the first electric power is preferably set in consideration of this point.

Notably, in the case where the first electric power is changed stepwise or continuously, the average value of electric power in the first energization period $T_1$ must be greater than the average value of the second electric power.

(b) In the above-described embodiment, the GCU 21 is configured to control energization of the glow plug 1 (metal glow plug) having the heating coil 9. The object controlled by the GCU 21 is not limited thereto. For example, the sizes of various members, the composition of the coil, etc., can be freely changed so that the glow plug 1 can be readily controlled by the GCU 21. Furthermore, the glow plug is not limited to a metal glow plug. Accordingly, the GCU 21 may be configured to control the energization of a ceramic glow plug having a ceramic heater.

(c) In the above-described embodiment, the GCU 21 and the ECU 41 are provided separately. However, the ECU 41 may be configured to provide the function of the GCU 21, and to perform energization control of the glow plug 1 by the function of the GCU incorporated into the ECU 41.

It should further be apparent to those skilled in the art that various changes in form and detail of the invention as shown and described above may be made. It is intended that such changes be included within the spirit and scope of the claims appended thereto.

This application claims priority from Japanese Patent Application No. 2010-133770 filed Jun. 11, 2010, the disclosure of which is incorporated herein by reference in its entirety.

What is claimed is:

1. An energization control apparatus for a glow plug which generates heat upon supply of electric current thereto and having a resistance which changes in positive correlation with a change in its own temperature, the energization control apparatus being adapted to control the supply of electric current to the glow plug in accordance with a resistance control scheme in which, when an internal combustion engine to which the glow plug is attached is stopped, electric current is supplied to the glow plug such that its temperature reaches a predetermined target temperature, a resistance of the glow plug at the time that the glow plug reaches the predetermined target temperature is obtained as a pre-correction target resistance, and the supply of electric current to the glow plug is controlled such that the resistance of the glow plug becomes equal to a target resistance based on the pre-correction target resistance, the energization control apparatus comprising:

calibration means for supplying electric current to the glow plug at a time of calibration when the internal combustion engine to which the glow plug is attached is stopped, to thereby obtain the pre-correction target resistance of the glow plug, wherein the calibration means supplies during a calibration period a predetermined first electric power to the glow plug in a predetermined first energization period, and supplies during the calibration period a predetermined second electric power to the glow plug after the first energization period;

the second electric power is set such that, when the second electric power is supplied to the glow plug and the temperature of the glow plug becomes saturated, the temperature of the glow plug becomes equal to the target temperature; and the first electric power is greater than the second electric power.

2. The energization control apparatus for a glow plug as claimed in claim 1, wherein the first energization period continues at least until the resistance of the glow plug exceeds a predetermined maximum pre-correction target resistance.

3. The energization control apparatus for a glow plug according to claim 1, wherein the first electric power is set such that, when the first electric power is supplied to the glow plug and the temperature of the glow plug becomes saturated, the temperature of the glow plug becomes equal to or lower than a heat-resistance temperature of the glow plug.

4. The energization control apparatus for a glow plug according to claim 1, wherein the predetermined first electric power and the predetermined second electric power are supplied to the glow plug in consecutive periods of time.

5. The energization control apparatus for a glow plug according to claim 4, wherein supply of the predetermined second electric power begins after supply of the first predetermined electric power has ended.

6. The energization control apparatus for a glow plug according to claim 1, wherein supply of the predetermined second electric power begins after supply of the first predetermined electric power has ended.

* * * * *